US005542274A

United States Patent [19]

Thordmark et al.

[11] Patent Number: 5,542,274

[45] Date of Patent: Aug. 6, 1996

[54] CYLINDER LOCK

[75] Inventors: Bo M. Thordmark, Hedemora; Lars Walldén, Eskilstuna, both of Sweden

[73] Assignee: ASSA AB, Eskilstuna, Sweden

[21] Appl. No.: 307,805

[22] PCT Filed: Mar. 26, 1993

[86] PCT No.: PCT/SE93/00261

§ 371 Date: Sep. 21, 1994

§ 102(e) Date: Sep. 21, 1994

[87] PCT Pub. No.: WO93/19267

PCT Pub. Date: Sep. 30, 1993

[30] Foreign Application Priority Data

Mar. 26, 1992 [SE] Sweden ..... 9200943

[51] Int. Cl.[6] ..... E05B 27/00; E05B 47/06

[52] U.S. Cl. ..... 70/495; 70/283; 70/277; 70/496

[58] Field of Search ..... 70/277–283, 495, 70/496

[56] References Cited

U.S. PATENT DOCUMENTS

| | | | |
|---|---|---|---|
| 3,287,944 | 11/1966 | Crumb | 70/495 |
| 4,393,673 | 7/1983 | Widen | 70/495 |
| 4,798,068 | 1/1989 | Nakauchi | 70/277 |
| 4,848,115 | 7/1989 | Clarkson et al. | 70/283 |
| 4,916,927 | 4/1990 | O'Connell et al. | 70/277 |
| 5,351,042 | 9/1994 | Aston | 70/283 |

FOREIGN PATENT DOCUMENTS

| | | |
|---|---|---|
| 278906 | 8/1988 | European Pat. Off. . |
| 281507 | 9/1988 | European Pat. Off. . |
| 303849 | 2/1989 | European Pat. Off. . |
| 453878 | 10/1991 | European Pat. Off. . |
| 3712300 | 10/1988 | Germany . |
| 653400 | 12/1985 | Switzerland . |

*Primary Examiner*—Steven N. Meyers
*Assistant Examiner*—Tuyet-Phuong Pham
*Attorney, Agent, or Firm*—Sughrue, Mion, Zinn, Macpeak & Seas

[57] ABSTRACT

A cylinder lock (1) comprises a lock cylinder (2) and a key-operated cylinder plug (3). A latching element (10) is located in the region of the boundary surface between the lock cylinder and the plug and is activated by an electrically actuable blocking element (11) which is movable between a release position and a blocking position. The plug cannot be turned by means of the key when the blocking element is in its blocking position. The latching element (10) has a length which is slightly shorter than the axial length of the plug (3).

9 Claims, 2 Drawing Sheets

20a
21
20b
20c
1
13a
12
11
11b
15
11a
10b
15
10
10a
10b
2
3
1
20

2
3
4a
4
4b
4c

CYLINDER LOCK

TECHNICAL FIELD

The present invention relates to a cylinder lock comprising a cylinder plug which is mounted for rotation in a lock cylinder and which includes one or more lock elements, such as a row of pins or tumblers or a side-bar which are activated directly or indirectly by means of a key. The cylinder lock further includes a latching element which is mounted in the lock cylinder and which in an active position prevents turning of the plug and in a release position permits the plug to be turned, the latching element being urged by spring means towards its latching position and coacts with an electrically activated blocking element, wherein in one position the blocking element permits the latching element to move radially to its release position, and in another position blocks the latching element in its locking position.

In addition to their normal key-operated fuction, cylinder locks of this kind which also include an electrically-operated blocking function find use in many different areas. One such area is in controlling access to a locality or building in which a person in possession of a key to the lock is autorized access to the locality or building only at certain times of the day. The electric blocking function is able to prevent access automatically at predetermined times.

In other cases, the lock key is provided with an electric code in addition to the normal key code. In this case, the key may include a transmitter which transmits a signal which is captured by an antenna located in the vicinity of the lock. When the signal transmitted from the key is the correct signal fort that particular lock, the electric blocking function of the lock is deactivated, therewith enabling the key to be used in the normal manner. This enables various passage control systems to be constructed without needing to provide authorized and unauthorized persons with a number of different keys at different times.

Naturally, attempts are made to force system locks that are equipped with electric blocking functions of the kind meant here, and it is therefore advantageous when the electrically activated blocking devices are able to make forcing of such locks more difficult.

BACKGROUND OF THE INVENTION

Various types of electrically actuable cylinder plug blocking devices are known to the art.

For instance, U.S. application Ser. No. 3,241,344 (Peters) discloses a key-activated cylinder lock which is intended to secure a deck lid, for instance, and which can also be activated electrically. This lock arrangement includes two mutually independent actuable locking devices which coact in a locked state but which can be actuated selectively and alternatively to open the lock. To this end, there is used a blocking element which is activated by an electromagnet or solenoid and which also coacts with a key-activated side-bar. The blocking element has a pointed end and engages with an obliquely positioned hook in the cylinder plug periphery, in the region of the side-bar. The cylinder lock can be opened by turning the key, whereupon the side-bar is withdrawn and the pointed end of the blocking element is displaced radially inwards while engaging the hook as the cylinder plug is turned against the action of a spring. The lock can also be opened by energizing the electromagnet, whereupon the blocking element shaft, which forms the electromagnet armature, is drawn into the coil so that the plug can be freely rotated.

CH-A-653,400 (Bauer Kaba) discloses a cylinder lock which includes an electromagnetically activated and axially movable side-bar which is mounted in a slot or recess in the end of the cylinder plug located outside the lock housing. When the side-bar is located in an axial position, the plug can be rotated by means of the key, whereas in another axial position the side-bar is accommodated in a recess which prevents the plug from being turned. EP-O 278,906 (Berchtold) discloses an electromagnetic cylinder lock provided with a key which is coded both electronically and mechanically. Electronic elements in the form of a microswitch and an electromagnet with armature are provided. The armature is movable in the direction of its long axis and forms part of a latching device which engages in the cylinder plug through the medium of a release pin and a particularly configured tumbler pin. Located parallel with the release pin is a latching pin which engages in the plug and also in the armature. In order to open the lock, it is necessary for the mechanical latching pin of the lock and also the microswitch, the release pin, the armature and the latching pin to be located in their correct positions.

This cylinder lock is comparatively complicated and its latching elements are comprised of radially movable pins of round cross-section. The electromagnet armature, which can be moved axially, is located at a not inconsiderable distance from the plug and the cylinder has relatively large dimensions, so as to be able to accommodate all components. The actual electromagnet armature has a complicated construction and includes several different grooves and recesses.

EP-A1-0 453,878 (BKS) describes a lock plunger which includes tumblers and an electromagnetic locking function A radially directed side-bar is spring-biassed outwardly to a release position. The head of the electromagnet armature lies against the side-bar and the armature is also urged radially outwards by means of a spring. When the electromagnet is energized, the armature is moved towards the cylinder plug and holds the side-bar in its latching position.

Thus, in this case, the lock includes a radially extending latching element, i.e. a latching element without axial extension which is activated by a radially directed electromagnet—for instance similar to the latching element in the arrangement disclosed in U.S. application Ser. No. 3,241,344.

The patent specification also discloses how to prevent the electromagnet from being rendered non-functional electrically by unauthorized persons attempting to open the lock.

Similar lock structures are described in EP-A2-0 281 507 (Zeiss Ikon) and EP-A1-0 303 849 (BKS).

In all of the aforedescribed lock plugs or cylinders, the plug is blocked electromagnetically by radially directed elements, primarily different types of pins which prevent the plug from being turned.

Locks of this kind are normally relatively easy to force. Another method of forcing such a lock is to use violence, such as to subject the pins to shear forces at the interface between plug and lock cylinder. The latching pins or like devices will fracture even when only a relatively moderate force is used on the lock, therewith enabling the lock to be opened.

OBJECT OF THE INVENTION

One object of the present invention is to eliminate the aforesaid drawbacks and other drawbacks of known locks of the kind meant here, i.e. locks which include two or more mutually independent latching or blocking devices, of which at least one can be activated electrically.

Another object is to provide a lock of the aforesaid kind in which the occurrence of shear forces in the electrically actuable latching elements of the lock are avoided to the greatest possible extent should the lock be subjected to violence or to vigorous vibrations in an attempt to open the lock.

A further object is to provide a lock of the kind meant here which has two or more mutually independent lock functions and which can be manufactured simply and is reliable in use.

SUMMARY OF THE INVENTION

These and other objects are fulfilled with an inventive cylinder lock of the aforedefined kind wherein the axial length of the latching element is substantially greater than its thickness or diameter. Further, the latching element extends axially in the region of the boundary surface between the lock cylinder and the cylinder plug and in their axial direction, and engages in an axially extending groove or recess in the plug. Also, it can move radially outwards to its release position, when the blocking element, which is mounted in the lock cylinder and has a part with an axial extension, is in its release position and the plug is turned by the key or in some other way.

Because the latching element has a certain axial length in relation to its thickness or diameter and is located in the region of the boundary surface or interface between the lock cylinder and the lock plug and coacts with a blocking element, the latching element can only be moved radially outwards from the cylinder plug when the blocking element is located in its release position, therewith rendering forcing of the lock difficult. If an attempt is made to force the lock, the latching element is held blocked, i.e. it is not free to move radially, therewith making forcing of the lock extremely difficult to achieve.

Further, shear forces are avoided when violence is used against a cylinder lock that is provided with a latching element of this kind, since the latching element will be subjected to pressure forces which tend to clamp the latching element in engagement with the blocking element.

Both the latching element and the blocking element may have a simple form, which are suitably adapted to one another, for instance so that projections on one of the elements are corresponded by recesses on the other element.

Preferably the blocking element is movable in its axial direction and will present a part having axial length which extends at a short distance from the latching element.

This enables the latching element and the blocking element to be readily adapted to one another, so that reliable blocking of the latching element can be ensured.

For example, according to one preferred embodiment, the mutually engaging parts of the latching element and the blocking element may include respective projections and recesses which coact mutually in the lock release position, wherein as the blocking element is displaced axially to its blocking position, the projections will engage with a plain part of the second element that lacks a recess and therewith block movement of the latching element to its release position.

The blocking element is conveniently moved axially by means of an electric motor, an electromagnet, a solenoid or some like device, preferably including a shaft which extends parallel with the axis of the latching element and the cylinder core.

One solution which has been found effective in practice is characterized in that axial movement of the blocking element is achieved by means of an electric motor whose output shaft coacts with an element which is connected to the blocking element and which converts rotary motion of the motor to rectilinear motion.

With an arrangement of this nature, the rotary motion of an electric motor can be converted to precise rectilinear motion for displacement of a blocking element, wherein the end positions of the blocking element which determine the blocking and release position extremities of the latching element are accurately defined. At the same time, the electrical component of the blocking arrangement can be given a simple and inexpensive design and will be highly reliable in operation. Furthermore, an arrangement of this nature also has the important advantage of being insensitive to heavy vibrations.

As before mentioned, the configuration of the latching element may vary. For instance, in the case of one embodiment, the latching element is comprised of a round rod having an axial extension which is slightly shorter than the length of the cylinder plug. Recesses are formed in the rod at appropriate positions thereon, these recesses corresponding to projections on the blocking element.

The latching element may preferably be pressed towards its latching position by means of springs which engage in the region of the ends of said element.

The invention will now be described in more detail with reference to a number of exemplifying embodiments thereof and also with reference to the accompanying drawings.

DESCRIPTION OF PREFERRED EMBODIMENTS

Figures 1, 2:
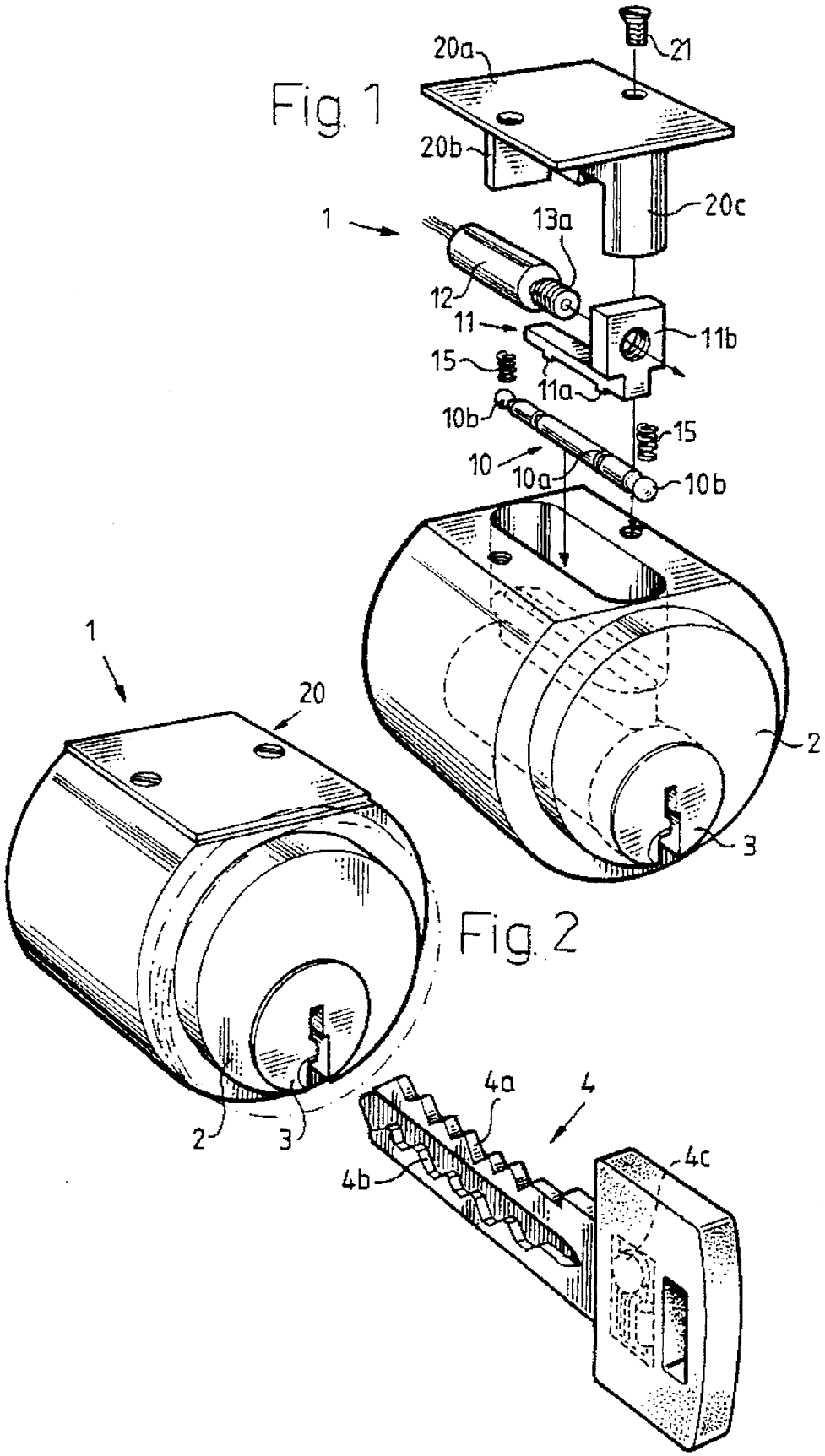
FIG. 1 is an exploded view of a cylinder lock in which the plug can be prevented from rotating by means of a latching element which is activated by an electrically operating blocking device.
FIG. 2 illustrates the cylinder lock of FIG. 1 in an assembled state and also shows a key belonging to the lock.

With reference to FIGS. 1–5, the reference numeral 1 identifies a cylinder lock having a lock cylinder 2 which accommodates a plug 3. The plug 3 can be rotated in a conventional manner, by means of a key 4 inserted into the key slot **3*a* of the plug 3**.

Figure 3:
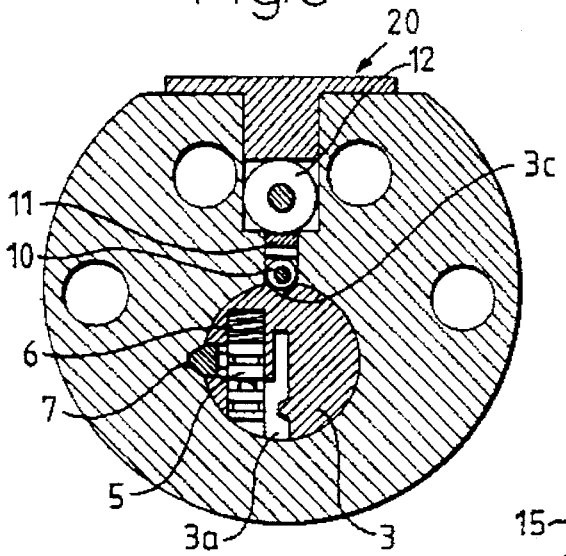
FIG. 3 is a sectional view of the cylinder lock of FIGS. 1 and 2, taken on the line III—III in FIG. 4.
Figure 4:
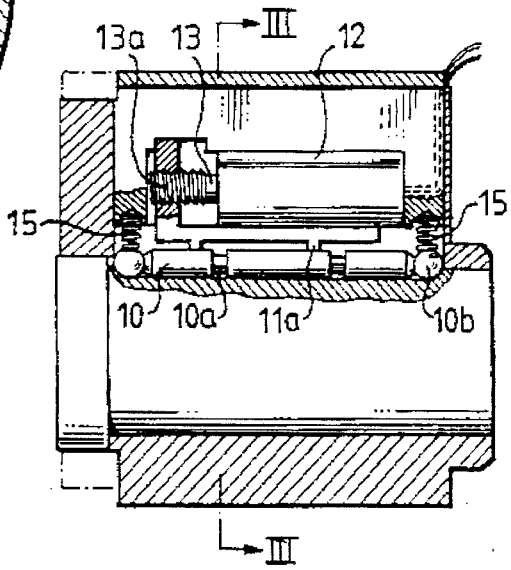
FIG. 4 is a sectional view of the cylinder lock of FIGS. 1–3, with the plug latching element shown in a blocked position.
Figure 5:
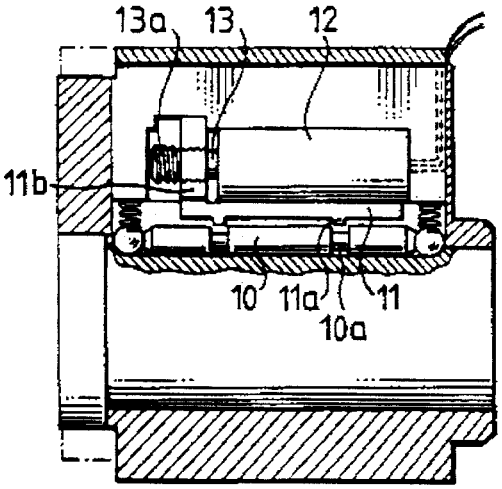
FIG. 5 is a view corresponding to the view of FIG. 4, showing the latching element in its release position.

The key 4 is provided with a top code **4*a* and a side code 4*b* which activate a row of side tumblers 5 biased by springs 6 which, in turn, activate a side-bar 7, as will be seen from FIG. 3. When the correct key is used to turn the plug 3, the side-bar 7** is able to move radially inwards in the plug, so as to enable the plug to be rotated.

The cylinder lock is also equipped with an electric blocking function, the active part of which is primarily a latching element 10 which engages in a V-shaped groove 3*c* in the peripheral surface of the plug 3. The latching element 10 has an axial length which is slightly shorter than the axial length of the plug and is located in the region of the boundary surface between the lock cylinder and the plug. When in its active position, the latching element 10 will therefore lock the plug against rotation by the key 4. This plug blocking function is achieved with the aid of a blocking element 11 which functions to block the latching element 10 and which can be moved axially between a release position, shown in FIG. 5, and a blocking position, shown in FIG. 4.

The latching element 10 has a round cross-section and is comprised of a cylindrical element having two circumferentially extending grooves 10*a* and spherical end-parts 10*b*. Springs 15 act against the end-parts 10*b* and urge the latching element 10 inwardly towards the plug.

The blocking element 11 has two projections 11*a* which engage with the periphery of the latching element when the blocking element is in its active blocking position. In the release position, i.e. when the blocking element 11 has been moved axially from the blocking position shown in FIG. 4 to the release position shown in FIG. 5, the projections 11*a* are in line with the grooves 10*a* on the latching element 10, therewith enabling the latching element to be pressed radially outwards as the plug 3 is turned with the key 4.

In the embodiment illustrated in FIGS. 1–5, this axial movement of the blocking element 11 is effected with the aid of an electric motor 12, the bearing shaft 13 of which has a screw-threaded part 13*a* which coacts with a corresponding screw thread on a nut part 11*b* connected to the blocking element 11. When the motor is energized, the motor shaft 13 is caused to rotate through a given number of revolutions, such that the blocking element 11 will move axially between its two end positions corresponding to the blocking position of the blocking element and its release position, respectively.

Figure 7:
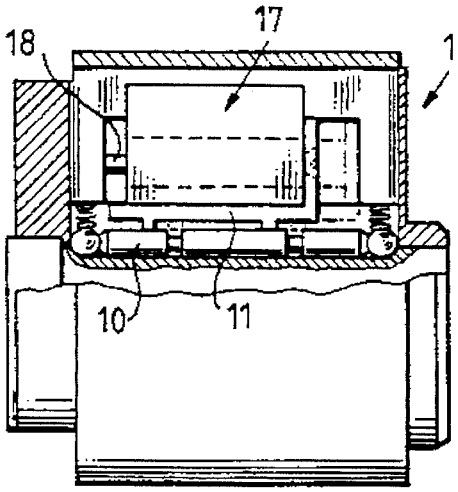
FIG. 7 is a partially cut-away side view of an inventive cylinder lock provided with another type of blocking device.

FIG. 7 illustrates a modified embodiment in which the electric motor 12 is replaced with an electromagnet whose coil 17 is connected to the blocking element 11. The armature 18 of the electromagnet lies against a stationary part of the unit which includes the electric drive means. When the electromagnet 17, 18 is energized, the coil 17 is caused to move to the right in FIG. 7, therewith moving the blocking element 11 from its active latching-element blocking position shown in FIG. 7 to its latching-element release position.

It will be understood that other types of electric drive means may alternatively be used.

FIG. 1 illustrates how the components of the electric drive means are carried by and mounted in the lock cylinder 2. The main part of the mounting device is comprised of a T-shaped element 20 having a plate 20*a* which is screwed firmly to the lock cylinder 2 by means of two screws 21. The mounting element 20 has two legs 20*b*, 20*c* which extend outwardly from the plate 20*a* and which carry the electric motor 12 and the blocking element therebetween.

Figure 6:
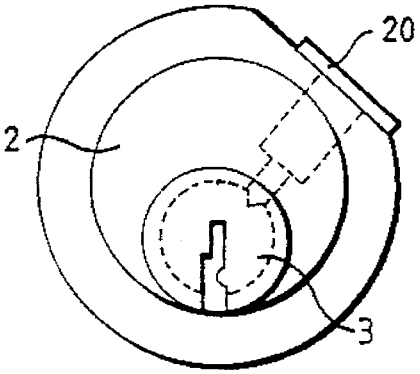
FIG. 6 is a front view of a modified embodiment of the cylinder lock of FIGS. 1–5.

It will be seen from FIG. 6 that the mounting element 20 and the parts associated therewith may alternatively be attached to the lock cylinder in another way. In the FIG. 6 embodiment, the plug 3 includes a row of tumblers which coact with the system code 4*a* of the key 4, without being obstructed by the electrical blocking means.

Various devices can be used to activate the electric blocking function. For instance, the blocking means may be controlled by a timer which at predetermined time points will send a start impulse to the motor 12 so as to cause the blocking element 11 to be moved to its blocking position. The lock cannot be opened with the key with the blocking element in its blocking position.

Alternatively, the key may be provided with a transmitter 4*c* which transmits code signals that are captured by an antenna on the lock cylinder, as indicated in FIG. 2. The antenna may be located within the region indicated in chain lines in FIG. 2 and is connected to an intelligent unit which detects the authenticity of the code signal transmitted by the key, and which when the code signal is found to be correct sends a start impulse to the motor 12 for movement of the blocking element 11 to its release position. The lock can then be opened after inserting and turning the key 4.

A blocking means constructed in accordance with the invention will fit all types of lock cylinders, such as round cylinders, oval cylinders and profiled cylinders, without requiring undue modification.

The configuration of the latching element 10 can vary within wide limits. An essential feature, however, is that the latching element will conform to the shape of the groove or recess in the cylinder plug. Its length may vary but preferably it exceeds half the axial length of the plug and may—as in the illustrated embodiments—often substantially correspond to the axial length of the plug.

The latching element, which shall be located in the region of the boundary surface between plug and lock cylinder, may, alternatively, comprise a plurality of separate elements which together function as indicated above. For instance, it is conceivable for the latching element to comprise a plurality of mutually adjacent balls or some similar elements of limited axial extension which together function as an element having a certain axial length and which coact with one or more suitably shaped blocking element(s) which is/are movable between release and blocking positions.

The invention claimed is:

1. A cylinder lock comprising a cylinder plug (3) which is mounted for rotation around an axially extending axis in a lock cylinder (2) and which includes one or more lock elements, the lock elements including at least one of a row of pins, tumblers and a side bar (7) which are activated directly or indirectly by means of a key (4), the cylinder plug (3) and lock cylinder (2) defining a boundary surface therebetween, and further comprising a latching element (10) which is mounted in the lock cylinder (2) and which in an active position prevents turning of the plug (3) and in a release position permits the plug to be turned, the latching element being urged radially by spring means (15) towards its latching position and coacts with an electrically activated blocking element (11), wherein in one position the blocking element (11) permits the latching element (10) to move radially to its release position, and in another position blocks the latching element in its locking position, wherein the latching element (10) has an axial length which is substantially greater than its thickness or diameter, further wherein the latching element extends axially in parallel with the axially extending axis of the cylinder plug (3) and in a region of the boundary surface between the lock cylinder (2) and the cylinder plug (3), engages in an axially extending groove (3*c*) or recess in the plug, and moves radially outwardly to its release position, when the blocking element (11), which is mounted in the lock cylinder and has a part with an axial extension extending in a direction parallel to the axially extending axis of the cylinder plug (3), is in its release position and the plug is turned by the key.

2. A cylinder lock according to claim 1, wherein the blocking element (11) is axially movable in the direction parallel to the axially extending axis of the cylinder plug (3) and that its part having the axial extension is located at a small distance from the latching element (10).

3. A cylinder lock according to claim 1 or 2, wherein mutually adjacent parts of the latching element (10) and the blocking element (11) include projections (11*a*) and recesses (10*a*) which coact mutually in the release position and which projections engage a part of the other element that lacks a recess as the blocking element (11) is moved axially to the blocking position, therewith blocking movement of the latching element (10) to its release position.

4. A cylinder lock according to claim 3, wherein axial movement of the blocking element (11) is achieved by means of one of an electric motor (12) and an electromagnet (17), having a shaft (13; 18) which is parallel with the axial length of the latching element and the axially extending axis of the cylinder plug.

5. A cylinder lock according to claim 4, wherein the axial movement of the blocking element is achieved by a rotary electric motor (12) whose output shaft (13) produces rotary motion and coacts with an element which is connected to the blocking element (11) and which functions to convert the rotary motion of the motor to rectilinear motion.

6. A cylinder lock according to claim 5, wherein said element which coacts with the output shaft and the blocking element, respectively, is comprised of one of a screw/nut arrangement and a worm gear.

7. A cylinder lock according to claim 5, wherein the electric motor output shaft (13, 13*a*) has a screw thread which coacts with a corresponding screw thread on a nut part (11*b*) which extends at-right angles to a part (11) functioning as a blocking element and is connected to said part, wherein when energized the electric motor rotates through a predetermined angle of rotation or a pre-determined number of revolutions in one or the other direction while moving the blocking element (11) between its end positions.

8. A cylinder lock according to claim 4, wherein the blocking element is connected to a movable part of the electromagnet.

9. A cylinder lock according to claim 1, wherein the spring means includes two spring (15) one engaging the latching element (10) at each one of its ends.

* * * * *